US009713931B2

(12) United States Patent
Sasaki

(10) Patent No.: US 9,713,931 B2
(45) Date of Patent: Jul. 25, 2017

(54) IMAGE FORMING APPARATUS

(71) Applicant: Konica Minolta, Inc., Chiyoda-ku, Tokyo (JP)

(72) Inventor: Eiji Sasaki, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/108,081

(22) PCT Filed: Dec. 15, 2014

(86) PCT No.: PCT/JP2014/083073

§ 371 (c)(1),
(2) Date: Jun. 24, 2016

(87) PCT Pub. No.: WO2015/098585

PCT Pub. Date: Jul. 2, 2015

(65) Prior Publication Data

US 2016/0325572 A1 Nov. 10, 2016

(30) Foreign Application Priority Data

Dec. 26, 2013 (JP) ..... 2013-269203

(51) Int. Cl.
*B41J 2/165* (2006.01)
*B41J 29/393* (2006.01)
(Continued)

(52) U.S. Cl.
CPC ..... *B41J 29/393* (2013.01); *B41J 2/0057* (2013.01); *B41J 2/165* (2013.01); *B41J 2/16579* (2013.01);
(Continued)

(58) Field of Classification Search
CPC ... B41J 2/01; B41J 2/0057; B41J 2/165; B41J 2/16579; B41J 2/16585; B41J 29/393;
(Continued)

(56) References Cited

U.S. PATENT DOCUMENTS 5,550,956 A * 8/1996 Tadokoro ..... G03G 15/01 347/19
5,917,511 A * 6/1999 Ueda ..... B41J 29/393 347/14
(Continued)

FOREIGN PATENT DOCUMENTS

JP 08197779 A 8/1996
JP 2001310478 A 11/2001
(Continued)

OTHER PUBLICATIONS

International Search Report corresponding to International application No. PCT/JP2014/083073; Date of Mailing: Mar. 3, 2015, with English translation.
(Continued)

*Primary Examiner* — Anh T. N. Vo
(74) *Attorney, Agent, or Firm* — Cantor Colburn LLP

(57) ABSTRACT

An image forming apparatus includes a image forming unit that forms an image on a recording medium P, a second storage unit that stores the history information about the maintenance of the image forming unit, and a control unit that, when the history information stored in the second storage unit is updated, sets a test image formation cycle of forming a test image used to adjust the image forming unit in accordance with the updated history information.

10 Claims, 5 Drawing Sheets

(51) Int. Cl.
*G03G 15/00* (2006.01)
*B41J 2/005* (2006.01)

(52) U.S. Cl.
CPC ..... *B41J 2/16585* (2013.01); *G03G 15/55* (2013.01); *B41J 2002/16573* (2013.01); *G03G 2215/00569* (2013.01)

(58) Field of Classification Search
CPC ..... G03G 15/55; G03G 2215/00569; G03G 21/00
See application file for complete search history.

(56) References Cited

U.S. PATENT DOCUMENTS 6,367,992 B1 * 4/2002 Aruga ..... B41J 29/393 400/61
6,643,474 B2 * 11/2003 Kodama ..... G03G 15/55 399/21
7,063,469 B2 * 6/2006 Nomura ..... B41J 29/48 358/1.15
7,843,601 B2 * 11/2010 Yamada ..... G06K 15/02 355/23
9,176,448 B2 * 11/2015 Kobayashi ..... G03G 15/5058

FOREIGN PATENT DOCUMENTS

JP 2011027830 A 2/2011
JP 2012153096 A 8/2012
JP 2013163318 A 8/2013

OTHER PUBLICATIONS

Written Opinion of the International Searching Authority corresponding to International application No. PCT/JP2014/083073; Date of Mailing: Mar. 3, 2015, with English translation.

* cited by examiner

IMAGE FORMING APPARATUS

This is the U.S. national stage of application No. PCT/JP2014/083073, filed on Dec. 15, 2014. Priority under 35 U.S.C. §119(a) and 35 U.S.C. §365(b) is claimed from Japanese Application No. 2013-269203, filed Dec. 26, 2013, the disclosure of which is also incorporated herein by reference.

TECHNICAL FIELD

The present invention relates to an image forming apparatus.

BACKGROUND ART

An existing image forming apparatus forms a test image for adjusting an image in order to detect whether there is a problem in image formation. The test image is regularly formed on the margin of a recording medium or on a new recording medium. When, for example, a line sensor reads the test image and detects an error in the test image, a maintenance or correction process is performed.

The more frequently a test image is formed as described above, the earlier an error in the image formation can be found. This can reduce the paper waste due to an error in the image formation. On the other hand, forming a test images too frequently reduces the productivity in forming normal images and increases the paper waste due to the test images when the test images are formed on new recording medium.

In light of the foregoing, a configuration in which the user such as a maintenance engineer can arbitrarily set the cycle of forming a test image is proposed (e.g., refer to Patent Literature 1).

CITATION LIST

Patent Literature

Patent Literature 1: JP 8-197779 A

SUMMARY OF INVENTION

Technical Problem

However, when the user arbitrarily sets the cycle of forming a test image as described in Patent Literature 1, the discovery of an error in the image formation is sometimes delayed or the productivity in the normal image formation is sometimes reduced depending on the settings. This adversely increases the paper waste.

Solution to Problem

An object of the present invention is to provide an image forming apparatus in which the cycle of forming a test image can appropriately be set.

In order to solve the above problem, an image forming apparatus according to an invention of claim 1 includes: an image forming unit that forms an image on a recording medium; a storage unit that stores history information about maintenance of the image forming unit; and a control unit that, when the history information stored in the storage unit is updated, sets a test image formation cycle of forming a test image used to adjust the image forming unit in accordance with the updated history information.

Further, according to an invention of claim 2, in the image forming apparatus according to claim 1, the control unit changes a type of the test image used to adjust the image forming unit in accordance with the updated history information.

Further, according to an invention of claim 3, in the image forming apparatus according to claim 1 or 2, the image forming unit includes at least a recording head including a plurality of nozzles, and the history information includes replacement history of the recording head, cleaning history of the recording head, and operation time of the recording head.

Further, according to an invention of claim 4, in the image forming apparatus according to any one of claims 1 to 3, the image forming apparatus further includes: a count unit that counts the total number of recording media on which the image forming unit forms an image, the control unit determines before a job execution starts whether the test image formation cycle has been completed in accordance with a value of the count unit and, when the control unit determines that the test image formation cycle has been completed, the control unit controls the image forming unit to form the test image on a recording medium before the job execution starts.

Further, according to an invention of claim 5, in the image forming apparatus according to any one of claims 1 to 3, the image forming apparatus further includes: a count unit that counts the total number of recording media on which the image forming unit forms an image, the control unit determines after a job is completed whether the test image formation cycle has been completed in accordance with a value of the count unit and, when the control unit determines that the test image formation cycle has been completed, the control unit controls the image forming unit to form the test image on a recording medium after the job is completed.

Advantageous Effects of Invention

According to the present invention, the cycle of forming a test image can appropriately be set.

DESCRIPTION OF EMBODIMENTS

Figure 1:
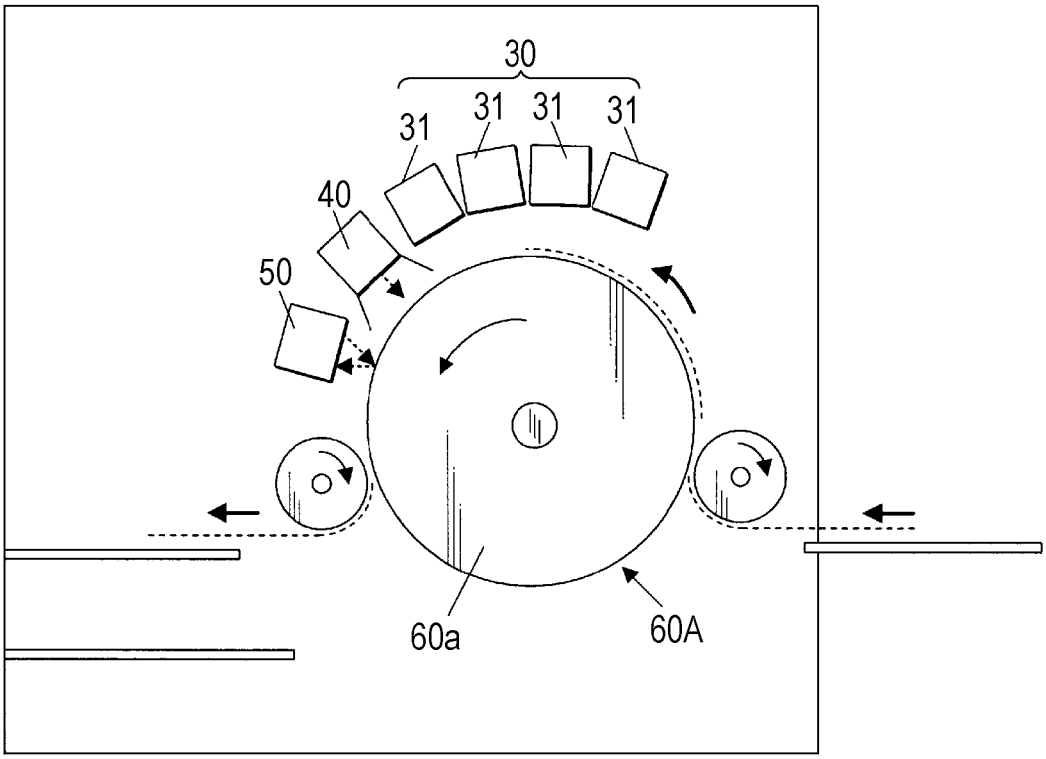
FIG. 1 is a diagram of a main configuration of an image forming apparatus that is an embodiment of the present invention.

The embodiments of the present invention will be described hereinafter with reference to the appended drawings. Various limitations that are technologically preferable in order to carry out the present invention are imposed on the embodiments to be described below. Note that, however, the scope of the invention is not limited to the embodiments and the examples illustrated in the drawings.

FIG. 1 is a diagram of a main configuration of an image forming apparatus 1 that is an embodiment of the present invention.

Figure 2:
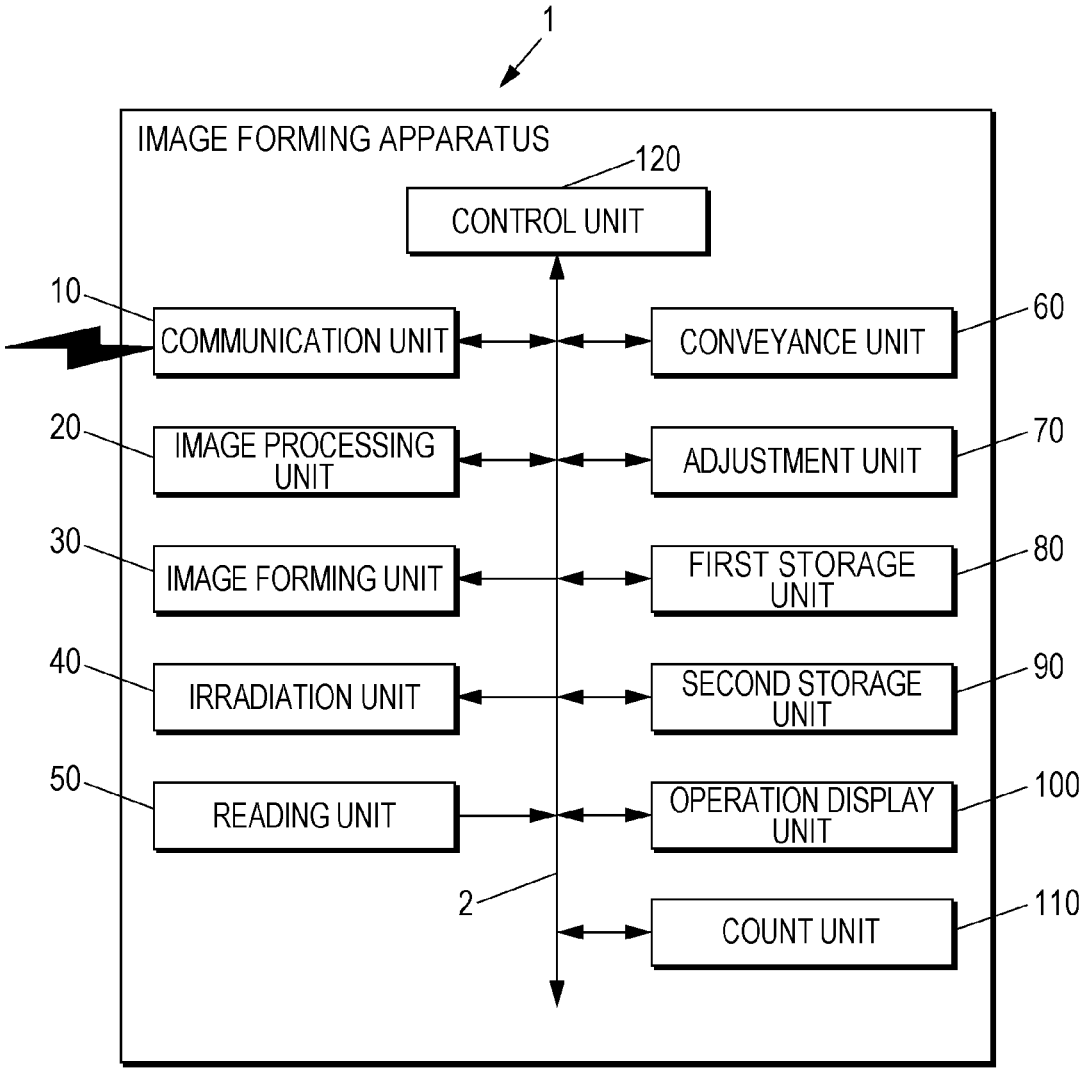
FIG. 2 is a block diagram of a main configuration of the image forming apparatus.

FIG. 2 is a block diagram of a main configuration of the image forming apparatus 1.

The image forming apparatus 1 includes, for example, a communication unit 10, an image processing unit 20, an image forming unit 30, an irradiation unit 40, a reading unit 50, a conveyance unit 60, an adjustment unit 70, a first storage unit 80, a second storage unit 90, an operation display unit 100, a count unit 110, and a control unit 120. The included components are connected to each other via a bus 2.

The communication unit 10 includes, for example, a Network Interface Card so as to connect an external device to the image forming apparatus 1 so that the image forming apparatus 1 can communicate with the external device.

For example, the communication unit 10 receives the job data transmitted from the external device.

The image processing unit 20 variously processes an image.

Specifically, the image processing unit 20 performs, for example, a process for generating vector data by analyzing the data in page description language included in the job data input via the communication unit 10, and a rasterizing process for generate bitmap data of the image data converted from the vector data generated by the analyzing process.

The image forming unit 30 forms an image on a recording medium P.

Specifically, the image forming unit 30 includes a recording head unit 31 provided with at least a recording head including a plurality of nozzles arranged in a predetermined direction.

The image forming unit 30 forms an image on the recording medium P by ejecting ink from the nozzles of the recording head of the recording head unit 31 to the recording medium P conveyed by the conveyance unit 60 in accordance with the bitmap data generated by the image processing unit 20.

The image forming unit 30 according to the present embodiment can perform color printing to form an image with the combination of a plurality of colors of ink (for example, cyan (C), magenta (M), yellow (Y), and black (K)). The recording head unit 31 of the image forming unit 30 is individually provided to each of the colors. Four recording head units 31 are provided in the present embodiment. However, the number is not limited to the embodiment.

The image forming unit 30 forms an image corresponding to the job data, for example, in an image formation area on the recording medium P.

Furthermore, the image forming unit 30 forms a test image for adjusting the image when the number of recording media P, each on which the image corresponding to the job data is formed, reaches a predetermined number of recording media (the number of recording media in an interval between test image forming processes). Note that, in the present embodiment, the test image can be formed in the margin of the recording medium P, or can be formed on a new recording medium P when the size of the margin is not large enough to form a test image.

Such a test image forming process for forming a test image will be described in detail below.

The irradiation unit 40 emits energy used to fix the image formed by the image forming unit 30 on the recording medium P.

The type of energy emitted from the irradiation unit 40 depends on the characteristic of the ink. For example, when the recording head unit 31 of the image forming unit 30 uses an ultraviolet curable ink, which is cured by the ultraviolet irradiation, the energy emitted from the irradiation unit 40 is ultraviolet. In this example, the irradiation unit 40 includes, for example, an irradiation source such as a Light Emitting Diode (LED) emitting ultraviolet (UV). The irradiation unit 40 emits ultraviolet to the recording medium P conveyed by the conveyance unit 60.

By the energy emitted from the irradiation unit 40, the ink ejected on the recording side of the recording medium P is cured and fixed on the recording side.

The reading unit 50 reads the image on the recording medium P.

Specifically, the reading unit 50 includes, for example, a linear image sensor provided with a predetermined number of imaging elements arranged in a predetermined direction, such as a charge-coupled device (CCD) image sensor, or a Complementary Metal Oxide Semiconductor (CMOS) image sensor; a generation unit that generates image data in accordance with the electric signal output from the imaging element; and a light source that emits a light to the recording medium P. The reading unit 50 reads the image formed on the recording medium P by scanning the recording medium P conveyed by the conveyance unit 60 and moving along the reading unit 50. More specifically, the reading unit 50 emits a light from the light source to the recording medium P and detects the light reflected from the recording medium P using the linear image sensor so as to generate and output the image data (the read image data) corresponding to the reading results in accordance with the electric signal output in response to the detection result.

The conveyance unit 60 conveys the recording medium P to the image forming unit 30, the irradiation unit 40, and the reading unit 50.

Specifically, the conveyance unit 60 includes, for example, a cylindrical drum **60*a*. The provided drum 60*a* can rotate around the shaft passing through the center of the diameter of the cylinder so as to support the recording medium P on its outer periphery. By rotating the drum 60*a*, the conveyance unit 60 conveys the recording medium P supported on the outer periphery while making a side of the recording medium P face the image forming unit 30, the irradiation unit 40, and the reading unit 50**.

The image forming unit 30, the irradiation unit 40, and the reading unit 50 are provided near the position through which the rotating outer periphery of the drum **60*a* passes and along the rotating outer periphery. Specifically, the image forming unit 30, the irradiation unit 40, and the reading unit 50 are provided in order, as illustrated in FIG. 1, from the upstream side to the downstream side of the conveyance path on which the passing outer periphery of the drum 60*a*** conveys the recording medium P.

The conveyance unit 60 further includes a detection unit (not illustrated) that detects the rotation angle of the drum **60*a* so as to detect the position of the recording medium P supported and conveyed on the outer periphery of the drum 60*a* in accordance with the rotation angle of the drum 60*a* detected by the detection unit. The detection unit is, for example, an encoder provided on the rotation shaft of the drum 60*a*. However, the detection unit is not limited to the example, and can have any configuration that can detect the rotation angle of the drum 60*a***.

Note that the conveyance unit 60 has a configuration including a mechanism that turns the recording medium P upside down (the switchback mechanism). The conveyance unit 60 conveys the recording medium P after turning the recording medium P upside down using switchback mechanism. This enables the conveyance unit 60 to convey both the front side and reverse side of a medium such as the recording medium P while making the both sides face the image forming unit 30 in turn. Additionally, when the recording medium P is turned upside down with the switchback mechanism and conveyed, a test image can be formed on either the front side or reverse side.

The adjustment unit 70 determines whether the image forming unit 30 correctly reproduces the colors in accordance with a comparison result between the colors used to form the test image and the colors indicated in the result of reading the test image with the reading unit 50, respectively. The adjustment unit 70 adjusts the color reproduction of the image forming unit 30 in accordance with the determination results.

Specifically, the adjustment unit 70 compares the colors of the original image data of the test image with the colors of the read image data. In other words, the adjustment unit 70 compares, for example, the color value of each pixel of the original image data of the test image with the color value of each pixel of the read image data. When there is a difference between the compared color values, the adjustment unit 70 determines whether the image forming unit 30 correctly reproduces the colors in accordance with the relationship between the difference and a predetermined threshold. When determining that there is a problem on the color reproduction of the image forming unit 30, the adjustment unit 70 performs adjustment operation to adjust the output signal so that the colors are correctly reproduced.

Note that the adjustment unit 70 includes, for example, an integrated circuit such as PLD or ASIC, or a circuit including the combination thereof. The function as the adjustment unit 70 is implemented on the integrated circuit. However, the implementation is not limited to the example. For example, a part or whole of each function can individually be provided on a circuit.

The first storage unit 80 includes, for example, a data readable/writable semiconductor memory.

The first storage unit 80 stores the image data of a plurality of types of pattern images, which is the original image data of the test image.

The types of pattern images are, for example, predetermined for the recording heads provided in each of the recording head units 31, or for the recording head units 31, respectively. However, the types of the pattern images are not limited to the example.

The second storage unit 90 includes, for example, a data readable/writable semiconductor memory.

The second storage unit 90 stores the history information about the maintenance of the image forming unit 30 and "the number of recording media in an interval between test image forming processes" used to set a cycle to form a test image, linking the history information and the number of recording media to each other.

The history information about each recording head includes items, for example, the ID, the operation time, the standby time, the type of ink, the replacement history, the cleaning history, and the set number of recording media for test image formation.

The ID is the information used to identify each recording head.

The operation time is the information indicating the total time while each recording head ejects ink.

The standby time is the information indicating the total time while each recording head does not eject ink.

The type of ink is the information indicating the type of ink that each recording head ejects (for example, YMCK).

The replacement history is the information including, for example, the date when each recording head is replaced.

The cleaning history is the information including, for example, the date when each recording head is cleaned (when the recording head is wiped).

The set number of recording media for test image formation is the information used to set, on each recording head, the number of recording media P on which each recording head forms an image corresponding to the job data until each recording head forms a test image.

One or more of the items in the history information described above is updated when the maintenance (including the replacement of the recording head and cleaning of the recording head) is performed or when a process for forming an image corresponding to the job data is performed.

An arbitral number of recording media is initially set as the number of recording media in an interval between test image forming processes by the user such as a maintenance engineer or a maintenance service provider. When, for example, maintenance is performed or a process for forming an image corresponding to the job data is performed, the item of the set number of recording media for test image formation in the history information is updated. With the update, the smallest set number is selected among the set numbers of recording media for test image formation of the recording heads in the history information as the number of recording media in an interval between test image forming processes.

After that, when the number of recording media P, each on which an image corresponding to the job data is formed, reaches the number set as the number of recording media in an interval between test image forming processes, a test image is formed. The formed test image is a test image for the recording head having the set number of recording media for test image formation selected as the number of recording media in an interval between test image forming processes. In other words, in accordance with the updated history information, the type of the test image used to adjust the image forming unit 30 is changed.

A process for setting the number of recording media in an interval between test image forming processes will be described in detail below.

The operation display unit 100 detects the various type of input operation for the operation of the image forming apparatus 1 while outputting the various displays related to the operation of the image forming apparatus 1.

Specifically, the operation display unit 100 includes, for example, a display device including a touch panel input device or a switch provided for the contents of the various types of input operation. The operation display unit 100 outputs the various displays related to the operation of the image forming apparatus 1 with the display device under the control by the control unit 120. The operation display unit 100 detects the input operation by the user to the touch panel input device or to the switch, and outputs the signal corresponding to the contents of the detected input operation to the control unit 120.

The count unit 110 is a counter that counts the total number of recording media P each on which the image forming unit 30 forms an image corresponding to the job data.

Specifically, when the image formation according to the job data is performed, the count unit 110 counts the number of recording media P each on which an image is formed in accordance with the job, and adds the counted number to the counter value.

The control unit 120 performs various processes for controlling the operation of the image forming apparatus 1.

Specifically, the control unit 120 includes, for example, a Central Processing Unit (CPU), a Random Access Memory (RAM), and a Read Only Memory (ROM). The CPU reads, for example, a program or data corresponding to the contents of a process from a storage device such the ROM and executes the program or data so as to control the operation of each unit of the image forming apparatus 1. The CPU stores, for example, the program or data read in the process, or a parameter generated in the process into the RAM.

The specific operation of the image forming apparatus 1 will be described hereinafter.

The image forming apparatus 1 according to the present embodiment updates the history information stored in the second storage unit 90 when the maintenance (including the replacement of the recording head and cleaning of the recording head) is performed. With the update, the number of recording media in an interval between test image forming processes is set. A test image is formed when the number of recording media P each on which an image is formed reaches the number of recording media in an interval between test image forming processes.

The process for setting the number of recording media in an interval between test image forming processes and the process for forming a test image will be described with reference to FIGS. 3 and 4.

Figure 3:
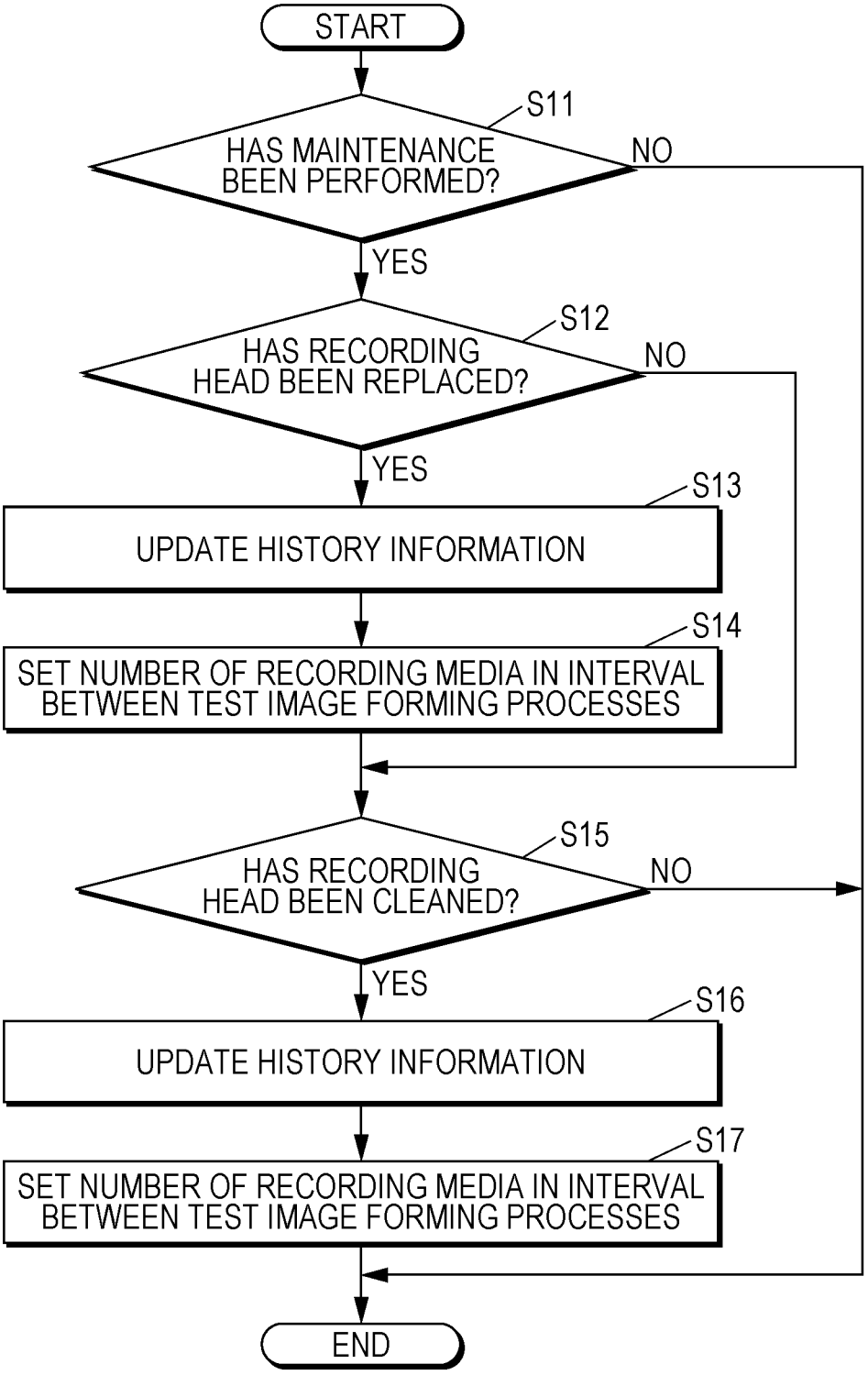
FIG. 3 is an explanatory flowchart of a process for setting the number of recording media in an interval between test image forming processes.

FIG. 3 is an explanatory flowchart of a process setting the number of recording media in an interval between test image forming processes performed with the maintenance. The process for setting the number of recording media in an interval between test image forming processes is performed with the control unit 120.

First, in step S11, the control unit 120 determines whether maintenance is performed. When determining that maintenance is not performed (step S11: NO), the control unit 120 terminates the process. When determining that maintenance is performed (step S11: YES), the control unit 120 determines in step S12 whether a recording head is replaced.

When determining in step S12 that a recording head is not replaced (step S12: NO), the control unit 120 performs the process in step S15 to be described below.

On the other hand, when determining that a recording head is replaced (step 12: YES), the control unit 120, in step S13, updates the history information stored in the second storage unit 90.

Specifically, the control unit 120 updates the replacement history of the replaced recording head in the history information so as to change the date of replacement to the date when the recording head is replaced. The control unit 120 initializes the set number of recording media for test image formation set on the replaced recording head in the history information.

Next, in step S14, the control unit 120 sets the number of recording media in an interval between test image forming processes, which is stored in the second storage unit 90, in accordance with the history information updated in step S13.

Specifically, the control unit 120 selects the smallest set number among the set numbers of recording media for test image formation, each of which is set on each recording head in the history information, and sets the selected number as the number of recording media in an interval between test image forming processes.

Next, in step S15, the control unit 120 determines whether a recording head is cleaned.

When determining in step S15 that a recording head is not cleaned (step S15: NO), the control unit 120 terminates the process.

On the other hand, when determining that a recording head is cleaned (step S15: YES), the control unit 120, in step S16, updates the history information stored in the second storage unit 90.

Specifically, the control unit 120 updates the cleaning history of the cleaned recording head in the history information so as to change the date of cleaning to the date when the recording head is cleaned. The control unit 120 adds a predetermined value to be added per cleaning to the set number of recording media for test image formation set on the cleaned recording head in the history information.

Next, in step S17, the control unit 120 sets the number of recording media in an interval between test image forming processes, which is stored in the second storage unit 90, in accordance with the history information updated in step S16. Then, the control unit 120 terminates the process.

Specifically, the control unit 120 selects the smallest set number among the set numbers of recording media for test image formation, each of which is set on each recording head in the history information, and sets the selected number as the number of recording media in an interval between test image forming processes.

Using the process described above for setting the number of recording media in an interval between test image forming processes increases the set number of recording media for test image formation set on a recording head when the recording head is replaced with a new one. Similarly, when any one of the recording heads is cleaned, the set number of recording media for test image formation set on the cleaned recording head is also increased. In other words, the set number of recording media for test image formation is set on each recording head in accordance with the condition of the recording head (whether the recording head is new or old, or how much the recording head is smudged).

The number of recording media in an interval between test image forming processes is set in synchronization with the recording head for which a test image needs being formed first among all of the recording heads.

Figure 4:
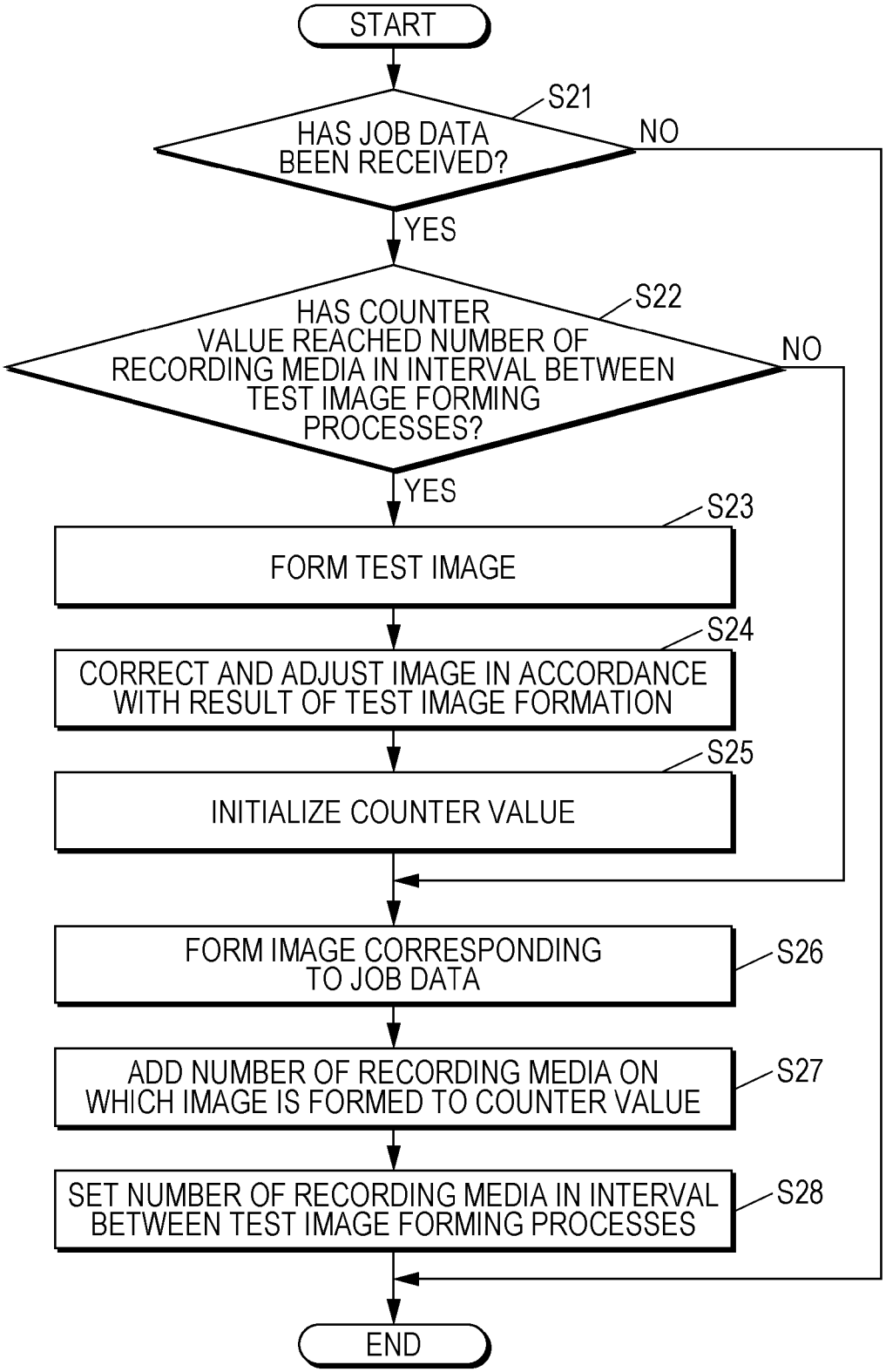
FIG. 4 is an explanatory flowchart of a process for forming a test image.

FIG. 4 is an explanatory flowchart of a process for forming a test image. The image forming process is performed with the control unit 120.

First, in step S21, the control unit 120 determines whether the communication unit 10 receives the job data. When the communication unit 10 does not receive the job data (step S21: NO), the control unit 120 terminates the process.

On the other hand, when the communication unit 10 receives the job data (step S21: YES), the control unit 120 determines in step S22 whether the number of recording media reaches the number of recording media in an interval between test image forming processes.

Specifically, the control unit 120 determines whether the counter value of the count unit 110 is larger than or equal to the value of the number of recording media in an interval between test image forming processes, which is set in the second storage unit 90.

When determining that the counter value does not reach the number of recording media in an interval between test image forming processes (step S22: NO), the control unit 120 performs the process in step S26 to be described below.

On the other hand, when determining that the counter value reaches the number of recording media in an interval between test image forming processes (step S22: YES), the control unit 120 forms a test image by controlling the image forming unit 30 in step S23.

Next, in step S24, the control unit 120 performs correction and adjustment in accordance with the result of the test image formation by controlling the adjustment unit 70.

Next, in step S25, the control unit 120 initializes the counter value of the count unit 110.

Next, in step S26, the control unit 120 performs an image forming process according to the job data by controlling the image forming unit 30.

Next, in step S27, the control unit 120 adds the number of recording media on which an image is formed in the image forming process performed in step S26 to the counter value of the count unit 110.

Next, in step S28, the control unit 120 sets the number of recording media in an interval between test image forming processes in accordance with the image forming process performed in step S26, and then terminates the process.

Specifically, the control unit 120 updates the history information (the operation time, the standby time, and the set number of recording media for test image formation of each recording head) stored in the second storage unit 90 in accordance with the image forming process performed in step S26, and sets the number of recording media in an interval between test image forming processes.

In the image forming process, it is determined before a job execution starts whether the counter value reaches the number of recording media in an interval between test image forming processes. When the counter value reaches the number of recording media in an interval between test image forming processes, a test image is formed. After that, the image forming process according to the job data is performed. After the image forming process according to the job data is performed, the number of recording media in an interval between test image forming processes is set in accordance with the image forming process.

As described above, the present embodiment includes: the image forming unit 30 that forms an image on the recording medium P; the second storage unit 90 that stores the history information about the maintenance of the image forming unit 30; and the control unit 120 that sets the number of recording media in an interval between test image forming processes as a test image formation cycle of forming a test image used to adjust the image forming unit 30 in accordance with the updated history information when the history information stored in the second storage unit 90 is updated.

Thus, the number of recording media in an interval between test image forming processes is set in accordance with the condition of the image forming unit 30. Thus, the cycle of forming a test image can appropriately be set.

Accordingly, this can prevent the image forming apparatus according to the present embodiment from forming a test image too frequently, and from excessively delaying a process for forming normal images. This also enables the image forming apparatus to detect an error in the image formation as soon as possible, and can prevent the image forming apparatus from wasting paper.

The control unit 120 according to the present embodiment changes the type of the test image used to adjust the image forming unit 30 in accordance with the updated history information.

This enables the image forming apparatus to form an optimal type of test image at an appropriate timing in accordance with the condition of the image forming unit 30.

According to the present embodiment, the image forming unit 30 includes at least a recording head including a plurality of nozzles. The history information includes the replacement history of the recording head, the cleaning history of the recording head, and the operation time of the recording head.

This enables the image forming apparatus to set the number of recording media in an interval between test image forming processes in accordance with the replacement of the recording head, the cleaning of the recording head, or the operation time of the recording head.

The present embodiment includes a count unit 110 that counts the total number of recording media P each on which the image forming unit 30 forms an image. The control unit 120 determines before a job execution starts whether the value of the count unit 110 reaches the number of recording media in an interval between test image forming processes. When determining that the counter value reaches the number of recording media in an interval between test image forming processes, the control unit 120 forms a test image on the recording medium P by controlling the image forming unit 30 before the job execution starts.

This enables the image forming apparatus to forma test image before a job execution starts, and thus enables the image forming apparatus to determine an error in the image formation before an image corresponding to the job data is formed.

In the embodiment, the example in which it is determined before a job execution starts whether the counter value reaches the number of recording media in an interval between test image forming processes, and then a test image is formed in accordance with the determination result has been described. Note that, however, the time to form a test image is not limited to the example.

For example, the control unit 120 can determine after a job is completed whether the counter value reaches the number of recording media in an interval between test image forming processes in accordance with the value of the count unit 110. When determining that the counter value reaches the number of recording media in an interval between test image forming processes, the control unit 120 can form a test image on the recording medium P by controlling the image forming unit 30 after the job is completed.

Figure 5:
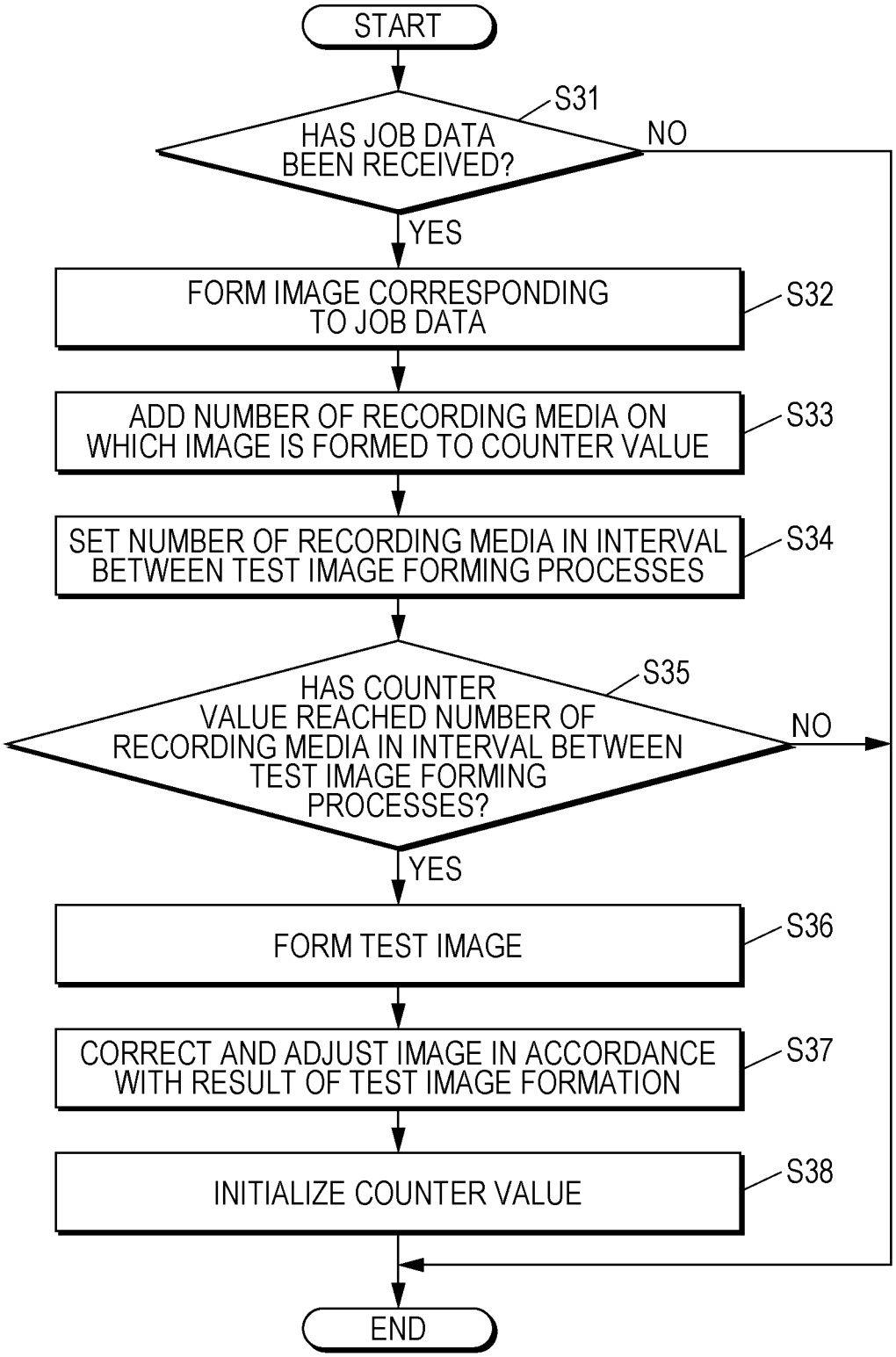
FIG. 5 is an explanatory flowchart of a process for forming a test image in another embodiment.

FIG. 5 is an explanatory flowchart of the process described above for forming an image. The image forming process is performed with the control unit 120.

The process in step S31, steps S32 to S34, and steps S35 to S38 of FIG. 5 correspond to the process in step S21, steps S26 to S28, and steps S22 to S25 of FIG. 4, respectively.

In the embodiment, the example in which a test image is formed before a job execution starts or after a job is completed has been described. However, a test image can be formed in the middle of a job execution.

In such a case, before a job execution starts, it is determined in accordance with the job data whether the counter value reaches the number of recording media in an interval between test image forming processes in the middle of the job execution.

Next, it is determined whether the recording medium P when the counter value reaches the number of recording media in an interval between test image forming processes includes a margin large enough to form a test image therein. When the recording medium P includes a margin large enough to forma test image therein, a test image is formed in the margin in the middle of the job execution. On the other hand, when the recording medium P does not include a margin large enough to forma test image therein, a test image is formed either when the job execution starts or when the job is completed.

In the embodiment, the example in which the number of recording media in a interval for forming a test image (the number of recording media in an interval between test image forming processes) as the test image formation cycle is set in response to the update of the history information. Alternatively, for example, the operation time used as an interval for forming a test image can be set as the test image formation cycle in response to the update of the history information. In such a case, the recording head operating for the longest operation time is selected among the recording heads so that it is determined whether the operation time of the selected recording head reaches a predetermined length of operation time in order to forma test image.

INDUSTRIAL APPLICABILITY

The present invention is applicable to an image forming apparatus.

REFERENCE SIGNS LIST

1 Image forming apparatus
10 Communication unit
20 Image processing unit
30 Image forming unit
31 Recording head unit
40 Irradiation unit
50 Reading unit
60 Conveyance unit
70 Adjustment unit
80 First storage unit
90 Second storage unit
100 Operation display unit
110 Count unit
120 Control unit
P Recording medium

The invention claimed is:

1. An image forming apparatus comprising:

an image forming unit that forms an image on a recording medium;

a storage unit that stores history information about maintenance of the image forming unit; and a control unit that, when the history information stored in the storage unit is updated, sets a test image formation cycle of forming a test image used to adjust the image forming unit in accordance with the updated history information;

wherein the image forming unit includes at least a recording head including a plurality of nozzles, and the history information includes replacement history of the recording head, cleaning history of the recording head, and operation time of the recording head.

2. The image forming apparatus according to claim 1, wherein the control unit changes a type of the test image used to adjust the image forming unit in accordance with the updated history information.

3. The image forming apparatus according to claim 2, further comprising:

a count unit that counts the total number of recording media on which the image forming unit forms an image, wherein the control unit determines before a job execution starts whether the test image formation cycle has been completed in accordance with a value of the count unit and, when the control unit determines that the test image formation cycle has been completed, the control unit controls the image forming unit to form the test image on a recording medium before the job execution starts.

4. The image forming apparatus according to claim 2, further comprising:

a count unit that counts the total number of recording media on which the image forming unit forms an image, wherein the control unit determines after a job is completed whether the test image formation cycle has been completed in accordance with a value of the count unit and, when the control unit determines that the test image formation cycle has been completed, the control unit controls the image forming unit to form the test image on a recording medium after the job is completed.

5. The image forming apparatus according to claim 1, further comprising:

a count unit that counts the total number of recording media on which the image forming unit forms an image, wherein the control unit determines before a job execution starts whether the test image formation cycle has been completed in accordance with a value of the count unit and, when the control unit determines that the test image formation cycle has been completed, the control unit controls the image forming unit to form the test image on a recording medium before the job execution starts.

6. The image forming apparatus according to claim 1, further comprising:

a count unit that counts the total number of recording media on which the image forming unit forms an image, wherein the control unit determines after a job is completed whether the test image formation cycle has been completed in accordance with a value of the count unit and, when the control unit determines that the test image formation cycle has been completed, the control unit controls the image forming unit to form the test image on a recording medium after the job is completed.

7. An image forming apparatus comprising:

an image forming unit that forms an image on a recording medium;

a storage unit that stores history information about maintenance of the image forming unit;

a control unit that, when the history information stored in the storage unit is updated, sets a test image formation cycle of forming a test image used to adjust the image forming unit in accordance with the updated history information; and a count unit that counts the total number of recording media on which the image forming unit forms an image, wherein the control unit determines before a job execution starts whether the test image formation cycle has been completed in accordance with a value of the count unit and, when the control unit determines that the test image formation cycle has been completed, the control unit controls the image forming unit to form the test image on a recording medium before the job execution starts.

8. The image forming apparatus according to claim 7, wherein the control unit changes a type of the test image used to adjust the image forming unit in accordance with the updated history information.

9. An image forming apparatus comprising:

an image forming unit that forms an image on a recording medium;

a storage unit that stores history information about maintenance of the image forming unit;

a control unit that, when the history information stored in the storage unit is updated, sets a test image formation cycle of forming a test image used to adjust the image forming unit in accordance with the updated history information; and a count unit that counts the total number of recording media on which the image forming unit forms an image, wherein the control unit determines after a job is completed whether the test image formation cycle has been completed in accordance with a value of the count unit and, when the control unit determines that the test image formation cycle has been completed, the control unit controls the image forming unit to form the test image on a recording medium after the job is completed.

10. The image forming apparatus according to claim 9, wherein the control unit changes a type of the test image used to adjust the image forming unit in accordance with the updated history information.

* * * * *